US006473908B1

(12) United States Patent
Bontems

(10) Patent No.: US 6,473,908 B1
(45) Date of Patent: Nov. 5, 2002

(54) GARMENT HAVING A BUTTOCKS CLEAVAGE REVEALING FEATURE

(76) Inventor: Thomas A. Bontems, 1909 E. Palmcroft Dr., Tempe, AZ (US) 85282

( * ) Notice: Subject to any disclaimer, the term of this patent is extended or adjusted under 35 U.S.C. 154(b) by 0 days.

(21) Appl. No.: 10/042,965

(22) Filed: Jan. 9, 2002

(51) Int. Cl.[7] ..... A41B 9/00

(52) U.S. Cl. ..... 2/227; 2/228; 2/69; 2/400

(58) Field of Search ..... 2/400–408, 227, 2/228, 238, 67, 211, 105, 69, 79, 80, 78.1, 83, 78.2, DIG. 1; 450/94, 95, 99, 102–105, 108; D2/700, 712, 718, 731, 732–738, 742

(56) References Cited

U.S. PATENT DOCUMENTS 3,828,368 A * 8/1974 Lam ..... 2/227
4,377,008 A * 3/1983 Jung ..... 2/403
4,501,024 A * 2/1985 Russo ..... 2/67
4,813,081 A * 3/1989 Cliff et al. ..... 2/115
5,341,515 A * 8/1994 Cohen ..... 2/400
5,896,581 A * 4/1999 Wong ..... 2/78.2
5,970,516 A * 10/1999 Shimooka ..... 2/69

* cited by examiner

*Primary Examiner*—Gloria M. Hale
(74) *Attorney, Agent, or Firm*—Parsons & Goltry; Robert A. Parsons; Michael W. Goltry

(57) ABSTRACT

Disclosed is a garment having a buttocks covering portion and a buttocks cleavage-revealing portion disposed at the buttocks covering portion. The buttocks cleavage-revealing portion is an opening and see-through material is disposed at the opening. The garment is a pant having leg portions depending from a waist, and the opening is disposed below the waist.

17 Claims, 1 Drawing Sheet

GARMENT HAVING A BUTTOCKS CLEAVAGE REVEALING FEATURE

FIELD OF THE INVENTION

This invention relates to clothing for the human body.

BACKGROUND OF THE INVENTION

Dress is covering, or clothing and accessories, for the human body. The variety of dress is immense, varying with different sexes, cultures geographic areas, and historic eras. And so the term dress encompasses not only such familiar garments as shirts, skirts, trousers, jackets and coats but also footwear, caps and hats, sleepwear, sports clothes, corsets and gloves.

The basic functions of dress are to provide warmth and protection, to beautify or enhance sexual appeal and to supply information about the wearer (i.e., age, sex, social status, occupation). Dress serves many purposes, however, and is not defined solely by such relatively straightforward and practical roles. Indeed, throughout the history of costume, many styles of clothing have been worn that do not satisfy any one of these functions. Furthermore, people's perceptions of which garments or styles best serve such functions are not universal or constant. For example, even through women in other parts of the world had been wearing trousers for centuries, in Europe and North America pants were considered inappropriate and unattractive wear for women until the 20th century.

Fashion functions as not only a reflection of social and economic standing but also as a reflection of peoples' attitudes and personalities. Some people are conservative and wear conservative dress, whereas others are less inhibited and wear revealing or highly stylistic dress. Certainly today young people drive fashion trends. Presently the most prevalent fashion trend is clothing that is designed to reveal the human body or to exhibit the shape of form of the human body. Tight fitting clothes and low cut jeans are examples of the current fashion trend. However, tight fitting clothes and low cut jeans, while revealing, are uncomfortable for many. As a result, what is needed is a garment that is comfortable to wear, easy to make, inexpensive and that incorporates a revealing feature that does not detract from or govern the overall structure of the garment.

SUMMARY OF THE INVENTION

The above problems and others are at least partially solved and the above purposes and others realized in a garment having a buttocks covering portion and a buttocks cleavage-revealing portion disposed at the buttocks covering portion. In one embodiment, the buttocks cleavage-revealing portion is an opening through the garment. In another embodiment, the buttocks cleavage-revealing portion is an opening through the garment with see-through material disposed at the opening. The opening can take on any desired shape, such as heart-shaped , logo-shaped, flower-shaped, butterfly-shaped, football helmet-shaped, etc. The garment is preferably a pant, but it can be any garment having a buttocks-covering portion, such as a skirt, a dress, shorts, etc.

Consistent with the foregoing, the invention also contemplates associated methods of manufacture. In one such embodiment, the invention provides a method including providing a garment having a buttocks-covering portion and disposing a buttocks cleavage revealing portion at the buttocks covering portion.

BRIEF DESCRIPTION OF THE DRAWINGS

Referring to the drawings.

DETAILED DESCRIPTION OF A PREFERRED EMBODIMENT

Figure 1:
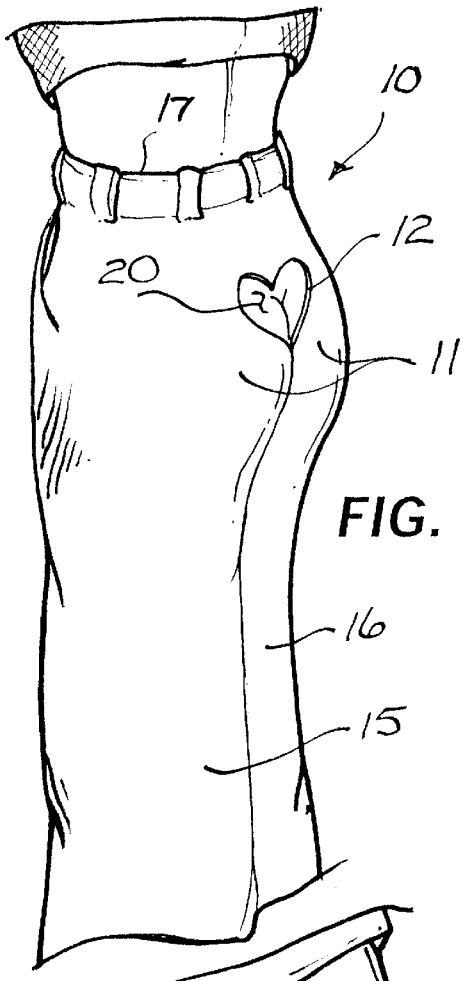
FIG. 1 is a perspective view a garment shown as it would appear being worn, in accordance with the principle of the invention, the garment including a buttocks covering portion and a buttocks cleavage-revealing portion disposed at the buttocks covering portion, the buttocks cleavage-revealing portion including an opening shaped like a heart.

Turning now to the drawings, in which like reference characters indicate corresponding elements throughout the several views, attention is first directed to FIG. 1 in which is seen a garment, embodying the principle of the instant invention, generally indicated by the reference character 10 including a buttocks covering portion (BCP) 11 and a buttocks cleavage-revealing portion (BCRP) 12 disposed at buttocks covering portion 11. In the embodiment depicted in FIG. 1, garment 10 is an outer garment and, more particularly, a pant or trouser for covering the human body from the waist to the ankles. And so garment 10 includes leg sections 15,16 to fit each leg separately, which lead away from a waist section or band 17. Leg sections 15,16 meet at the crotch of garment 10. The crotch of garment 10 is not explicitly depicted in FIG. 1. Garment 10 can include one or more other conventional features, such as belt loops at the waistband 17 as shown for receiving a belt, front pockets, rear pockets, a zippered or buttoned fly, etc. Garment 10 is made of cotton, polyester, cotton/polyester blend, wool, silk or other suitable woven or non-woven cloth material.

Set forth for purposes of orientation and reference in connection with the ensuing detailed description of a preferred embodiment of the instant invention, the foregoing brief description of garment 10 is intended to be generally representative of a typical pant. Details not specifically illustrated and described will be readily understood and appreciated by those skilled in the art.

In accordance with the invention, BCRP 12 is disposed at BCP 11 between band 17 and the crotch of garment 10. BCRP 12 is located specifically, so that when garment is worn as in FIG. 1 BCRP 12 reveals the butt cleavage of the wearer as shown. More particularly, BCRP 12 is specifically located to reveal the point at which the butt cleavage begins proximate the small of the wearer's back and also a portion of the butt cleavage extending downwardly therefrom. BCRP 12 is sufficiently large so that it also reveals flesh areas adjacent the described butt cleavage. In the embodiment designated 10, BCRP 12 is an opening 20 through BCP 11. Further to the present embodiment designated 10, opening 20 is heart-shaped. In providing opening 20, it can be formed by cutting away portions of BCP 11 or formed during the construction of garment 10.

The above described embodiment of the invention designated 10 is desirable by those who wish to exhibit a portion of their butt cleavage and who wish to make such a fashion statement. The remaining structure of garment 10 can be of any desired design and band 17 can be low cut, normally cut or high cut, in accordance with desired wishes. And so garment 10 can be made in accordance with any desired pant style or cut, with BCRP 12 providing the desired effect of revealing a portion of the wearer's butt cleavage as described.

Figure 2:
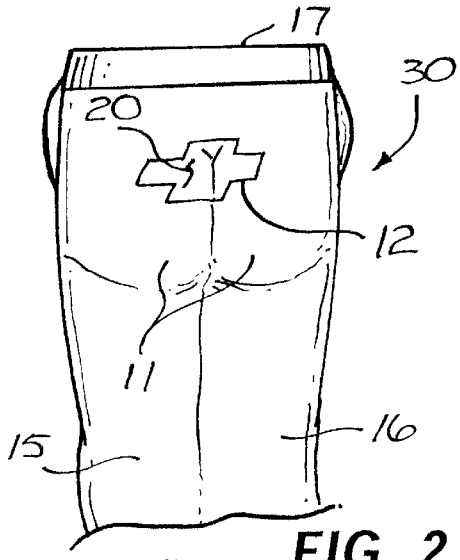
FIG. 2 is a rear elevation of another embodiment of a garment shown as it would appear being worn, in accordance with the principle of the invention, the garment including a buttocks covering portion and a buttocks cleavage-revealing portion disposed at the buttocks covering portion, the buttocks cleavage-revealing portion including an opening shaped like a logo.
Figure 3:
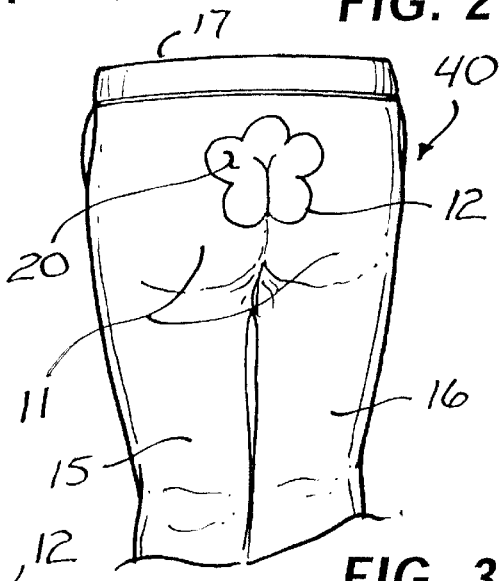
FIG. 3 is a rear elevation of yet another embodiment of a garment shown as it would appear being worn, in accordance with the principle of the invention, the garment including a buttocks covering portion and a buttocks-cleavage revealing portion disposed at the buttocks covering portion, the buttocks cleavage-revealing portion including an opening shaped generally like a flower.
Figure 4:
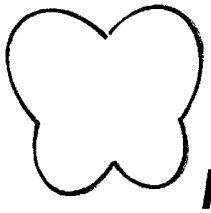
FIGS. 4 and 5 illustrate shapes of buttocks cleavage-revealing portions that are capable of being employed in connection with a garment having a buttocks covering portion.
Figure 5:
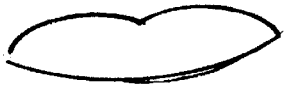

Opening 20 can take any desired shape and FIGS. 4 and 5 are illustrative of this, as are the embodiments depicted in FIGS. 2 and 3. The shape in FIG. 4 is generally representative of a butterfly and the shape in FIG. 5 is generally representative of a pair of human lips. Considering FIG. 2, there is seen an alternate embodiment of the invention, generally designated by the reference character 30. In common with the previously described embodiment designated 10, the immediate embodiment 30 shares BCP 11, BCRP 12, namely, opening 20, leg sections 15,16 and band 17. However, opening 20 of embodiment 30 is the shape of a popular vehicle logo, namely, a Chevrolet vehicle logo. Other logo-shapes can be used, and the logo-shape of opening 20 of embodiment 30 is illustrated as a matter of example of one such logo.

Turning to FIG. 3, there is seen another embodiment of the invention, generally designated by the reference character 40. In common with the previously described embodiment designated 10, the immediate embodiment 40 shares BCP 11, BCRP 12, namely, opening 20, leg sections 15,16 and band 17. However, opening 20 of embodiment 40 is flower-shaped.

Figure 6:
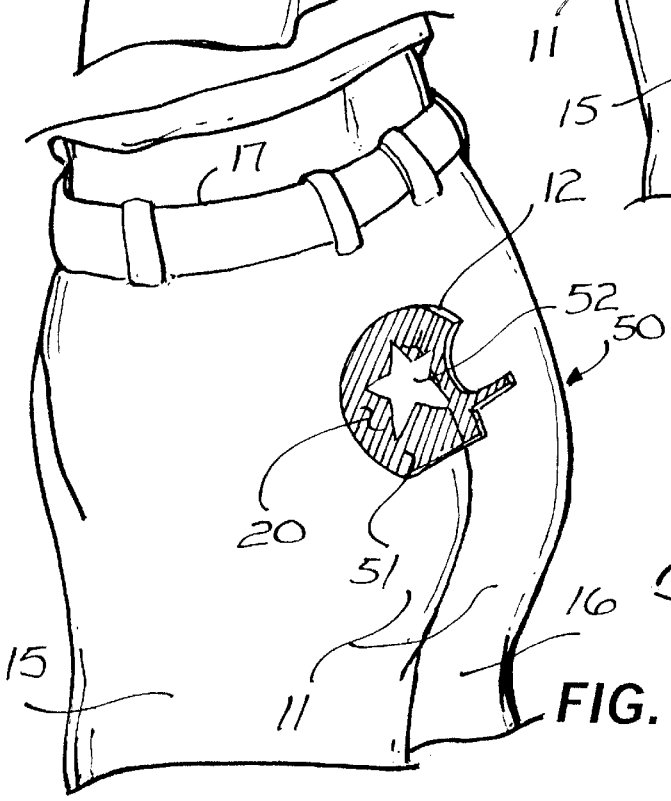
FIG. 6 is a perspective view a yet still another embodiment of a garment shown as it would appear being worn, in accordance with the principle of the invention, the garment including a buttocks covering portion and a buttocks cleavage-revealing portion disposed at the buttocks covering portion, the buttocks cleavage-revealing portion including an opening shaped like a football helmet and see-through material disposed at the opening.

Turning to FIG. 6, there is seen another embodiment of the invention, generally designated by the reference character 50. In common with the previously described embodiment designated 10, the immediate embodiment 50 shares BCP 11, BCRP 12, namely, opening 20, leg sections 15,16 and band 17. However, opening 20 of embodiment 40 is shaped like a football helmet (i.e., football helmet-shaped) and see-through material 51 is attached and disposed at opening 20. Material 50 occupies opening 20 and is attached with sewing and/or adhesive or by other suitable means. Material 51 is capable of being seen through, and is constructed of shear material, loosely woven material, clear plastic or other material that is capable of being seen through to a degree that is sufficient to allow onlookers to appreciate the wearer's butt cleavage. As a matter of example, a star-shaped piece 52 of material 52 is attached to material 51 with sewing and/or adhesive. The inclusion of piece 52 is depicted to illustrate that components are capable of being disposed at opening 20 for the purpose of an enhanced decorative effect. Although piece 52 is star-shaped, other shapes can be used. One or more pieces of material can be attached so as to be disposed at opening 20.

The present invention is described above with reference to a preferred embodiment. However, those skilled in the art will recognize that changes and modifications may be made in the described embodiments without departing from the nature and scope of the present invention. For instance, although the various embodiments of the invention are discussed in connection with a pant or trousers, the invention can be employed with any garment having a butt-covering portion, such as a skirt or dress, shorts, a bathing suit, etc. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus comprising:

a garment having a buttocks covering portion; and a buttocks cleavage-revealing portion disposed at the buttocks covering portion for revealing an upper portion of a cleavage of a buttocks, the buttocks cleavage revealing portion comprises an opening extending a distance sufficient to reveal only the upper portion of the cleavage.

2. The garment of claim 1, further comprising see-through material disposed at the opening.

3. The garment of claim 1, wherein the opening is heart-shaped.

4. The garment of claim 1, wherein the opening is logo-shaped.

5. The garment of claim 1, wherein the opening is flower-shaped.

6. The garment of claim 1, wherein the opening is butterfly-shaped.

7. The garment of claim 1, wherein the opening is football helmet-shaped.

8. The garment of claim 1, wherein the garment is a pant.

9. Apparatus comprising:

a pant having a buttocks covering portion; and a buttocks cleavage-revealing portion disposed at the buttocks covering portion for revealing an upper portion of a cleavage of a buttocks, the buttocks cleavage revealing portion comprises an opening extending a distance, the distance being sufficient to reveal only the upper portion of the cleavage from a first position above the cleavage to a second position intermediate the cleavage.

10. The garment of claim 9, further comprising see-through material disposed at the opening.

11. The garment of claim 9, wherein the opening is heart-shaped.

12. The garment of claim 9, wherein the opening is logo-shaped.

13. The garment of claim 9, wherein the opening is flower-shaped.

14. The garment of claim 9, wherein the opening is butterfly-shaped.

15. The garment of claim 9, wherein the opening is football helmet-shaped.

16. A method comprising steps of:

providing a garment having a buttocks covering portion; and disposing a buttocks cleavage-revealing portion at the buttocks covering portion for revealing an upper portion of a cleavage of a buttocks, the buttocks cleavage revealing portion comprises an opening extending a distance, the distance being sufficient to reveal only the upper portion of the cleavage from a first position above the cleavage to a second position intermediate the cleavage.

17. The method of claim 16, further comprising see-through material disposed at the opening.

* * * * *